US009493330B2

(12) United States Patent
Nestor et al.

(10) Patent No.: US 9,493,330 B2
(45) Date of Patent: Nov. 15, 2016

(54) MULTI-PURPOSE WRECKING TOOL

(71) Applicant: Kimberly L. Bohonko, Hamilton Square, NJ (US)

(72) Inventors: Russell J. Nestor, Trenton, NJ (US); Mark Slafkovsky, Yardville, NJ (US)

( * ) Notice: Subject to any disclaimer, the term of this patent is extended or adjusted under 35 U.S.C. 154(b) by 125 days.

(21) Appl. No.: 14/092,111

(22) Filed: Nov. 27, 2013

(65) Prior Publication Data

US 2014/0182107 A1 Jul. 3, 2014

Related U.S. Application Data

(60) Provisional application No. 61/731,641, filed on Nov. 30, 2012.

(51) Int. Cl.
*B66F 15/00* (2006.01)
*E04G 23/08* (2006.01)

(52) U.S. Cl.
CPC ..... *B66F 15/00* (2013.01); *E04G 23/08* (2013.01); *Y10T 29/49822* (2015.01)

(58) Field of Classification Search
CPC ..... B66F 15/00; B66F 19/00; E04G 23/08; B25C 11/00; B25C 13/00; Y10T 29/49815; Y10T 29/49822; Y10T 29/53796
See application file for complete search history.

(56) References Cited

U.S. PATENT DOCUMENTS 6,260,824 B1 7/2001 Aderhold
8,091,865 B2 1/2012 Eric
2007/0252117 A1* 11/2007 Harpell ..... B25C 11/00 254/1

* cited by examiner

*Primary Examiner* — Jason L Vaughan
*Assistant Examiner* — Amanda Meneghini
(74) *Attorney, Agent, or Firm* — Porzio, Bromberg & Newman, P.C.

(57) ABSTRACT

A multi-purpose wrecking tool in which a dual prying elements are coupled to a crossbar. Each of the dual prying elements having a pair of pry arms. Each of the pry arms extending at the same length from the crossbar. A handle coupled to a center portion of the crossbar. A slight curvature at the end of the handle connecting to the crossbar providing a predetermined angle between the handle and the crossbar. Each of the pry arms and the end of the handle including V shaped notches. The crossbar and pry arms provide controlled movement of the tool and improved leverage for removing of housing materials with reduced damage to the materials.

10 Claims, 2 Drawing Sheets

MULTI-PURPOSE WRECKING TOOL

CROSS REFERENCE TO RELATED APPLICATION

This application claims the benefit of U.S. Provisional Patent Application No. 61/731,641, filed Nov. 30, 2012, the entirety of which is hereby incorporated by reference into this application.

BACKGROUND OF THE INVENTION

1. Field of the Invention

The present invention relates to a multi-purpose wrecking tool for stabilizing and adding leverage during a demolition project.

2. Description of Related Art

Pry or wrecking bars are known for removing boards from floors, walls and other areas in which boards are attached to a structure.

U.S. Pat. No. 8,091,865 describes a lever bar which has an elongated shaft having two opposite distal ends. The first of the two opposite distal ends includes a crescent shaped portion having opposite end portions, both of the crescent opposite end portions respectively include flattened, clawed portions; and the second of the two opposite distal ends includes a flattened, pointed portion.

U.S. Pat. No. 6,260,824 describes a board saver pry bar. The pry bar having a handle, a crossbar, and two pairs of pry arms with each pair having a different length. The handle forms an acute angle with one pair of pry arms and an obtuse angle with the other pair of pry arms. The first pair of pry arms and the second pair of pry arms are parallel. Either pair of pry arms is placed behind the board to be removed then force is exerted against the handle to remove the board.

It is desirable to provide an improved multi-purpose wrecking tool providing with improved leverage which can be used for removing of housing materials with reduced damage to the materials.

SUMMARY OF THE INVENTION

The present invention relates to multi-purpose wrecking tool in which a dual prying elements are coupled to a crossbar. Each of the dual prying elements having a pair of pry arms. Each of the pry arms extending at the same length from the crossbar. Each of the pry arms and the end of the handle including notches.

Preferably, the crossbar is cylindrical. Each of the pry arms being slightly curved to an end. The shape of the crossbar and the pry arms provides a rocking, smooth movement of the tool.

A handle is coupled to a center portion of the crossbar. The handle including slight curvature at each end extending from an extended elongated section. The slight curvature at the end of the handle connecting to the crossbar providing a predetermined angle between the handle and the crossbar. The crossbar and pry arms provide smooth and controlled movement of the tool and improved leverage for removing of housing materials with reduced damage to the materials.

The invention will be more fully described by reference to the following drawings.

DETAILED DESCRIPTION

Figure 1:
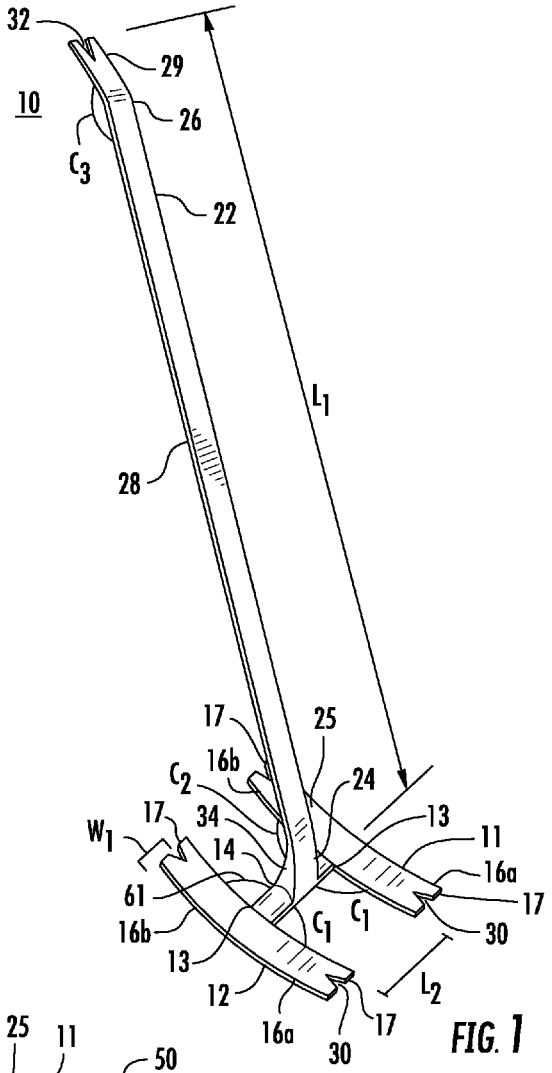
FIG. 1 is a schematic diagram of a multi-purpose wrecking tool.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic diagram illustrating multi-purpose wrecking tool 10. Dual prying elements 11 and 12 are coupled to crossbar 14. Dual prying elements 11 and 12 can be coupled to ends 13 of crossbar 14 or integral with cross bar 14. Preferably, crossbar 14 is cylindrical.

Each of the dual prying elements 11 and 12 have a pair of pry arms 16*a*, 16*b*. Each of pry arms 16*a*, 16*b* can extend at the same length $L_1$ from crossbar 14. Pry arm 16*a* and 16*b* can be integral to one another.

Each of pry arms 16*a*, 16*b* having a slight curvature $C_1$ to distal end 17. For example, a radius of curvature for $C_1$ can be selected to angle distal end 17 at an angle in the range of about 5 degrees to about 20 degrees from surface 20, shown in FIG. 2.

Referring to FIG. 1, handle 22 is coupled to center portion 24 of crossbar 14. Handle 22 includes proximal end 25 and distal end 26. Proximal end 25 and distal end 26 extend from extended elongated section 28. Proximal end 25 is coupled to crossbar 14. Pry arm 29 is coupled to distal end 26.

For example, a length $L_1$ of handle 22 can be in the range of about 24 inches and about 42 inches. Preferably, length $L_1$ of handle 22 is about 30 inches. It is preferable for crossbar 14 to have a length $L_2$ to be longer than a span of a single 2×4, double 2×4, or a single 4×4. For example, a length $L_2$ of crossbar 14 can be in the range of about 2½ inches to about 8 inches. Preferably, $L_2$ of crossbar 14 is about 5½ inches. For example, pry arms 16*a*,16*b* and can have a width $W_1$ in the range of about 1 inch to about 3 inches. Preferable pry arms 16*a*, 16*b* and pry arm 29 can have a width $W_1$ of about one and a half inches.

Proximal end 25 of handle 22 includes a slight curvature $C_2$ providing a predetermined angle between crossbar 14 and handle 22. For example, a radius of curvature $C_2$ can be selected to angle handle 22 at an angle in the range of about 40 degrees to about 60 degrees from crossbar 14. Preferably, the radius of the curvature $C_2$ is about 50 degrees.

Distal end 26 includes a slight curvature $C_3$. For example, a radius of curvature $C_3$ can be selected to angle pry arm 29 from handle 22 at an angle in the range of about 25 degrees to about 35 degrees. Preferably, the radius of curvature $C_3$ is about 30 degrees.

Tool 10 can be made of a suitable metal, such as steel. It will be appreciated that dual prying elements 11 and 12, pry arm 29 and handle 22 can be coupled to crossbar 14 as known to one of ordinary skill in the art, such as by welding. Alternatively, dual prying elements 11 and 12, pry arm 29 and handle 22 can be integral with crossbar 14.

Figure 2:
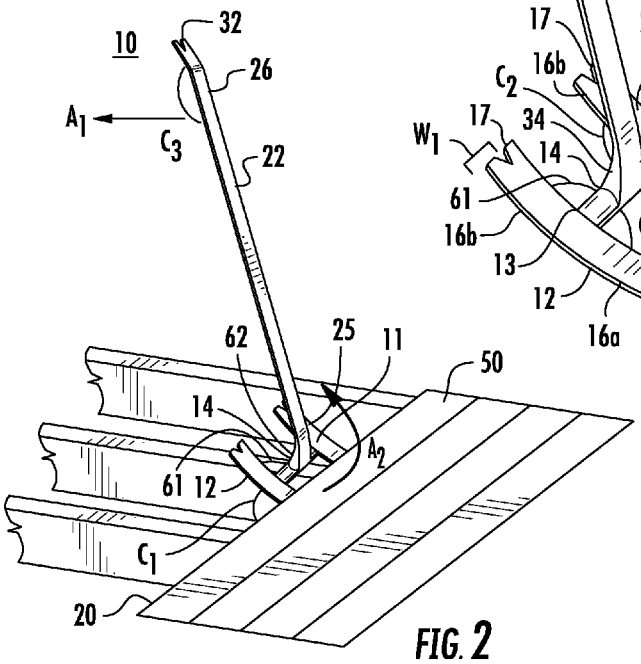
FIG. 2 is a schematic diagram of use of the multi-purpose wrecking tool.
Figure 3:
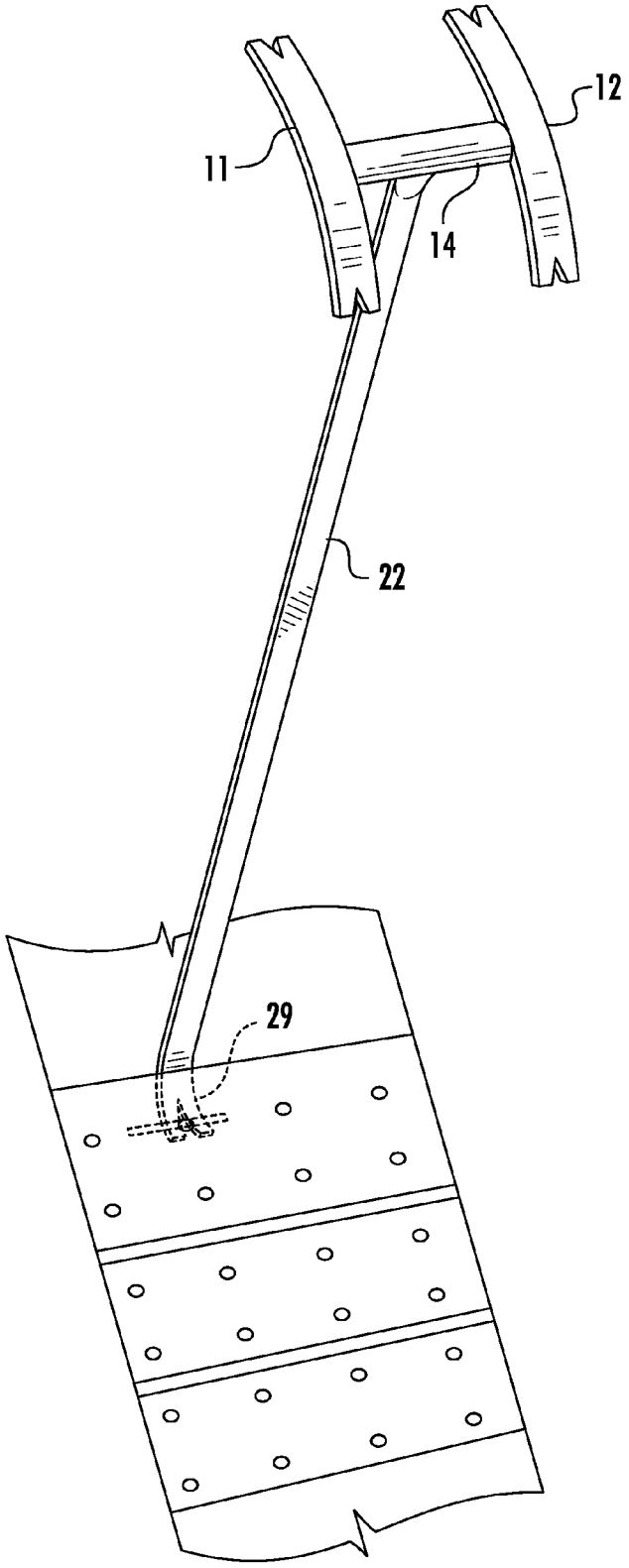
FIG. 3 is a schematic diagram of use of the multi-purpose wrecking tool.

Pry arms 16*a*, 16*b* can include V-shaped notch 30. Pry arm 29 can include V-shaped notch 32. FIG. 2 illustrates use of multi-purpose wrecking tool 10. Dual prying elements 11 and 12 are positioned under a surface of board 50. Applying force in the direction of arrow $A_1$ rotates tool 10 in the direction of arrow $A_2$ for lifting board 50. In an alternate use, pry arm 29 can be used to apply force against or over a material such as a wall board or ceiling tile, or underlayment for removal of same, as shown in FIG. 3.

The combination of dual prying elements in a rocking motion provides enhanced stability from rolling left or right during a prying activity.

Whether on a flat surface with the prying elements or utilizing the cylindrical crossbar over a perpendicular member, the tool stabilizes itself during the lifting motion. The tool stays engaged with a product to be removed on flat surfaces and even some angled surfaces, including 90 degrees, when the crossbar straddles a vertical member.

When handle 22 and prying end 29 are thrust under a surface to be lifted, crossbar 14 with its cylindrical shape acts like a handle of a shovel for directing force and lifting.

Dual pry arms 16 can also be grasped with both hands to exert upward or downward force for lifting or prying. V-shaped notch 32 allows the user to engage a fastener from under a surface being lifted elevating the fastener to a point where it can be grasped and extracted easily by reversing the tool and utilizing the dual prying elements. This performance allows for an existing product to be salvaged and be re-used if desired. The dual prying head assembly acts as a natural footprint for load distribution while engaged in a rocking and lifting application.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A multi-purpose wrecking tool comprising:

a crossbar having a first end and a second end, a handle extending from a portion of said crossbar between said first end and said second end, said handle having a proximal end and a distal end, said proximal end of said handle extending from the portion of said crossbar, said proximal end of said handle being angled from said cross bar with a first curvature to provide an angle between the cross bar and the handle in a range of about 40 degrees to about 60 degrees, the portion of said crossbar of which said handle extends is a center portion of said crossbar; and a first dual prying element coupled perpendicular to the first end of said cross bar and a second dual prying element coupled perpendicular to the second end of said cross bar, the first dual prying element comprising a pair of first pry arms extending in either direction at a same length from said first end of said cross bar, the first pry arms being integrally coupled to one another, the second dual prying element comprising a pair of second pry arms extending in either direction at a same length from said second end of said cross bar, the second pry arms being integrally coupled to one another, each of said first pry arms having a second curvature from the first end of said cross bar to a distal end of said first pry arm and each of said second pry arms having the second curvature from the first end of said cross bar to a distal end of said second pry arm, each of said first pry arms and said second pry arms include a V-shaped notch at the respective distal end of the first pry arm or the distal end of the second pry arm, said first and second pry elements are integral with the cross bar, wherein said second curvature provides an angle in a range of about 5 degrees to about 20 degrees.

2. The multi-purpose wrecking tool of claim 1 wherein the angle is about 50 degrees.

3. The multi-purpose wrecking tool of claim 1 wherein a distal end of said handle includes a third pry arm.

4. The multi-purpose wrecking tool of claim 3 wherein the distal end of said handle is angled from said third pry arm with a third curvature to provide an angle in a range of about 25 degrees to about 35 degrees.

5. The multi-purpose wrecking tool of claim 4 wherein the third pry arm at the distal end of said handle includes a V-shaped notch.

6. A method for removing a material comprising;

positioning a wrecking tool under the material, the wrecking tool comprising a crossbar having a first end and a second end, a handle extending from a portion of said crossbar between said first end and said second end, said proximal end of said handle being angled from said cross bar with a first curvature to provide an angle between the cross bar and the handle in a range of about 40 degrees to about 60 degrees, the portion of said crossbar of which said handle extends is a center portion of said crossbar and a first dual prying element coupled perpendicular to the first end of said cross bar and a second dual prying element coupled perpendicular to the second end of said cross bar, the first dual prying element comprising a pair of first pry arms extending in either direction at a same length from said first end of said cross bar, the first pry arms being integrally coupled to one another, the second dual prying element comprising a pair of second pry arms extending in either direction at a same length from said second end of said cross bar, the second pry arms being integrally coupled to one another, each of said first pry arms having a second curvature from the first end of said cross bar to a distal end of said first pry arm and each of said second pry arms having the second curvature from the first end of said cross bar to a distal end of said second pry arm, each of said first pry arms and said second pry arms include a V-shaped notch at the respective distal end of the first pry arm or the distal end of the second pry arm, said first and second pry elements are integral with the cross bar, said second curvature provides an angle in a range of about 5 degrees to about 20 degrees, the first and second dual prying elements being positioned under the material; and rotating the tool for lifting the material.

7. The method of claim 6 wherein the curvature of said crossbar is about 50 degrees.

8. The method of claim 6 wherein the wrecking tool further comprises a third pry arm at a distal end of said handle and further comprising the step of:

applying a force to the material using the third pry arm at the distal end of said handle.

9. The method of claim 8 wherein the distal end of said handle is angled from said third pry arm with a third curvature to provide an angle in a range of about 25 degrees to about 35 degrees.

10. The method of claim 9 wherein the third pry arm at the distal end of said handle includes a V-shaped notch.

* * * * *